United States Patent [19]

Gilcher

[11] 4,258,312

[45] Mar. 24, 1981

[54] VITAL VOLTAGE REGULATOR AND PHASE SHIFT CIRCUIT ARRANGEMENT

[75] Inventor: Heinz Gilcher, Export, Pa.

[73] Assignee: American Standard Inc., Swissvale, Pa.

[21] Appl. No.: 31,885

[22] Filed: Apr. 20, 1979

[51] Int. Cl.[3] ..... G05F 3/06

[52] U.S. Cl. ..... 323/306; 246/34 D; 307/314

[58] Field of Search ..... 246/34 R, 34 D, 34 CT; 323/61, 76, 108, 109, 110, 124; 324/416, 306; 307/237, 314, 232; 328/133, 171; 329/50; 361/204

[56] References Cited

U.S. PATENT DOCUMENTS

| | | | |
|---|---|---|---|
| 1,566,333 | 12/1925 | Lucas | 323/50 |
| 1,940,437 | 12/1933 | Osnos | 323/61 |
| 1,963,243 | 6/1934 | Osnos | 323/61 |
| 2,221,456 | 11/1940 | Pohm et al. | 323/61 |
| 3,970,271 | 7/1976 | Auer et al. | 246/28 R X |
| 4,188,002 | 2/1980 | Gilcher | 246/34 R |

*Primary Examiner*—J. D. Miller

*Assistant Examiner*—Reinhard J. Eisenzopf

*Attorney, Agent, or Firm*—R. W. McIntire, Jr.; A. G. Williamson, Jr.

[57] ABSTRACT

The primary winding of a saturable transformer is coupled to an alternating current source by a series tuned filter network. The transformer secondary winding is coupled to a load network by a second series filter tuned to the source frequency to block harmonics generated by the saturation limiting action of the transformer, which occurs below the normal voltage level of the source and regulates the output voltage supplied to the load within predetermined limits over the source operating voltage range. The first filter is tuned at a predetermined level above the source frequency to cooperate with the equivalent inductance of the unsaturated transformer and output network to hold the secondary output in phase with the input signal at a low levels of the source voltage. The first filter further cooperates with the reduced equivalent inductance of the saturated transformer and output network to change the effective frequency tuning to shift the phase of the secondary output with respect to the input signal at normal source voltage levels.

4 Claims, 6 Drawing Figures

VITAL VOLTAGE REGULATOR AND PHASE SHIFT CIRCUIT ARRANGEMENT

BACKGROUND OF THE INVENTION

My invention pertains to a vital voltage regulator and phase shift circuit arrangement. More specifically, the invention provides voltage regulator and phase shift apparatus for use with solid-state devices serving as track relays for alternating current track circuits on electrified railroads.

In electrified railroading, signal systems based on 100 Hz alternating current (AC) track circuits incorporating centrifugal motor type relays as track relays have been commonly used. One input for each track relay is connected to the track rails of the corresponding section, to be supplied with energy through those rails from the common 100 Hz AC track circuit source connected at the other end of the section while the second input is locally connected to the same source of track circuit energy. Systems using such track relays provide immunity against operation by the noncommercial alternating current propulsion energy, e.g., 25 Hz in one large electrified installation. It is also characteristic of such centrifugal relays to require approximately 68° phase difference between the two signal inputs for operation of the relay armature. Since long track circuits of the 100 Hz type normally have on the order of 60° phase angle lag in the track voltage at the receiver or relay end of the section, the phase difference between the track and local inputs to the centrifugal relay is sufficient to operate the relay when both signals are received, that is, when the track circuit is unoccupied. However, with a proposed conversion to commercial AC propulsion power, i.e., 60 Hz, the present centrifugal relays will not provide track circuit immunity from the propulsion energy. To continue use of the 100 Hz track circuit, which is desirable economically, a change in the track relay arrangement is therefore necessary. One such conversion arrangement is disclosed in my copending application for U.S. Pat., Ser. No. 953,527, filed Oct. 23, 1978, for a Vital Power Varistor Circuit for Railroad Signaling Systems, now U.S. Pat. No. 4,188,002 issued Feb. 12, 1980. This varistor circuit arrangement, and other proposed synchronous detector arrangements which may alternately be substituted for the centrifugal relay in the track circuit, require that the dual inputs be in phase. Therefore, a phase shift circuit for one signal input to the solid-state relay arrangement, preferably the local input signal, is required. Additionally, the varistor arrangement is a product device which also requires a regulated voltage input. Thus a voltage regulator is also required for proper operation and may be combined with the phase shift arrangement to provide a local input signal for the solid-state relay circuit arrangement having a regulated voltage and proper phase angle.

Accordingly, an object of my invention is a vital voltage regulator and phase shift circuit arrangement.

Another object of the invention is a vital circuit arrangement for regulating the voltage and phase of one input signal to a solid-state AC track relay.

Also an object of my invention is a vital voltage regulator and phase shift circuit apparatus for AC railroad track circuits to shift the phase of the local voltage input to the track relay means by a predetermined angle to match the phase angle shift of the track rail circuit input to that relay, so that the inputs are substantially in phase.

A further object of the invention is a vital circuit arrangement for regulating, within predetermined limits, the voltage level of the signal applied to one input of a dual input, solid-state AC relay arrangement and for shifting the phase angle of that signal to match the phase angle shift of the signal applied to the other input of the relay.

Still another object of my invention is an input circuit network for one input of a dual input, solid-state AC relay, including an energy source of selected frequency connected by a series LC filter to the primary winding of a saturable transformer, and a second LC filter coupling the secondary winding of that transformer to the relay load, for regulating the voltage and shifting the phase angle of the input signal to substantially match that of the signal applied to the relay second input which is received from a common source over a transmission line having a predetermined phase shift characteristic.

A still further object of the invention is a vital voltage regulator and phase shift arrangement for connecting one input of a solid-state track relay means to a local energy source in order to shift that input signal into phase with the track circuit input signal connected to the second relay input and further to regulate the voltage of the local input signal between predetermined limits to assure proper operation of the track relay means.

Other objects, features, and advantages of my invention will become apparent from the following specification and appended claims when taken in connection with the accompanying drawings.

SUMMARY OF THE INVENTION

According to the invention, the circuit arrangement includes a saturable transformer whose primary winding is coupled across the source of alternating current energy by a series LC filter path tuned slightly above the source frequency. The secondary of the transformer is coupled to a load through another series filter path tuned at the source frequency in order to attenuate any harmonics created by the saturable transformer limiting action at higher levels of the input voltage. When a low level, nonsaturating sinusoidal voltage is applied from the source, a sine wave signal is produced from the secondary of the transformer in phase with the source signal. When a higher level input signal is applied, the peak-to-peak value saturates the transformer at the peak of the curve and the secondary output amplitude is limited so that the amplitude of the output wave from the transformer is reduced over a portion of the half cycle. This holds the effective output voltage (the r.m.s. value) within a predetermined range throughout the normal operating range of the local source connected to the transformer and thus regulates the voltage supplied to the load. Since the filter in the secondary winding path eliminates harmonics created by the transformer limiting action, the signal applied to the load has a sinusoidal wave-form at the source frequency. However, the phase of this output signal leads that of the input signal due to both the limiting action of the saturable transformer and the shift in tuning of the input filter path effective as the equivalent input inductance of the transformer, load network changes (reduces) when saturation occurs. The phase shift is very abrupt at a predetermined input voltage but then holds relatively constant throughout the normal operating range of the input source. The circuit therefore holds the voltage signal applied to the load substantially steady throughout the normal operating range of the source to assure proper response by this load apparatus. When inserted in one input of a solid-state track relay for an AC track circuit, the arrangement assures that the local input signal is voltage regulated within the required limits for operation of the track relay. By reversing the output connections from the transformer secondary to the relay input, the phase shift may be translated into a lagging phase angle which substantially matches that created within the rail circuit connected to the relay second input terminals. The dual input signals are then substantially in phase to fulfill the operating requirement of such solid-state track relays so that they will properly respond to the conditions of the track section.

BRIEF OUTLINE OF THE DRAWINGS

Before defining the invention in the claims, I will describe in more specific detail a preferred circuit arrangement embodying the invention, as illustrated in the accompanying drawings, in which:

Figure 1A:
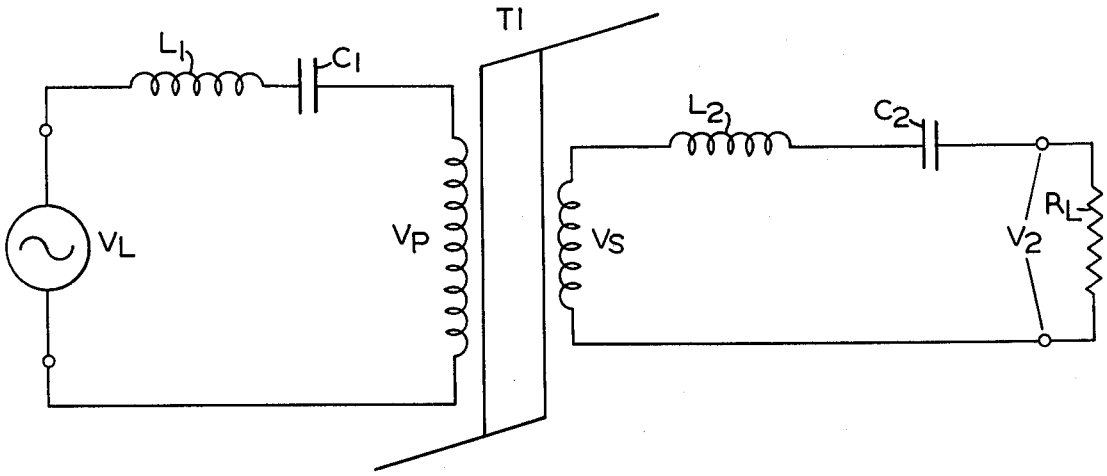
FIG. 1A is a diagrammatic illustration of a preferred voltage regulator and phase shift circuit arrangement embodying my invention.
Figure 3:
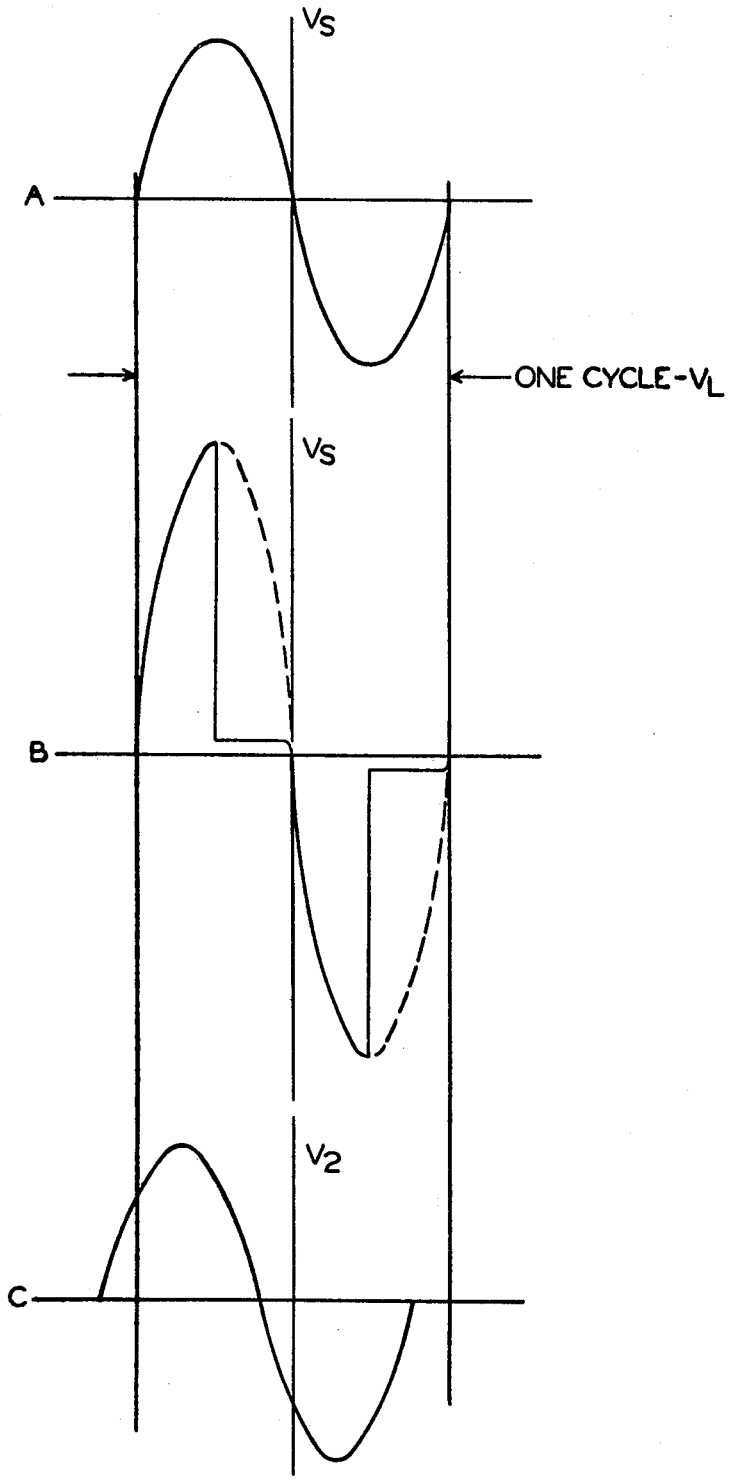

FIG. 3 includes three wave-form charts showing phase relationships, charts A and B illustrating the transformer secondary voltage in the FIG. 1A circuit under different input conditions and chart C showing the circuit output signal corresponding to chart B conditions.

In each of the drawing figures, similar references designate similar parts of the apparatus or equivalent functions.

DESCRIPTION OF THE ILLUSTRATED EMBODIMENT

Referring to FIG. 1A, a preferred form of the vital voltage regulator and phase shift circuit arrangement is shown as comprising a saturable transformer T1, shown by conventional symbol and having single primary and secondary windings, a series tuned input filter path consisting of inductor L1 and capacitor C1 connected in series with the primary winding, and a series tuned output filter including inductor L2 and capacitor C2 connected in series with the secondary winding to a resistive load designated by the resistance element $R_L$. A source of alternating current energy $V_L$, having a selected frequency and shown by conventional symbol, is connected across the series filter and primary winding circuit network. In a typical AC track circuit installation for an electric railroad, in which the FIG. 1A arrangement may be used, this source is common with that supplying the rail circuit and has a frequency of 100 Hz.

When a low level sinusoidal signal is applied from source $V_L$, it results in a nonsaturating voltage signal $V_P$ across the primary winding of transformer T1. Under these conditions, the output voltage $V_S$ from the secondary winding also has a sinusoidal wave-form and is in phase with the source voltage $V_L$ as shown in chart A of FIG. 3. However, when source voltage $V_L$ is at its normal level, e.g., 110 volts, r.m.s., the voltage level of signal $V_P$ is above the saturation limit of the transformer. The limiting action of transformer T1 upon saturation results in a secondary signal $V_S$ with a wave-form as shown in chart B of FIG. 3. Both filter elements suppress any electrical noise induced through the local source supply. However, the main purpose of the secondary filter network is to attenuate the harmonic frequencies developed by the limiting action of transformer T1 when the higher level input saturates the transformer. In other words, the filter network comprising inductor L2 and capacitor C2 blocks or attenuates the harmonics developed when the secondary output wave-form is as shown by chart B of FIG. 3. With the harmonics filtered out, the output voltage signal $V_2$ applied across load $R_L$ has a sine wave form, as shown by chart C of FIG. 3, but its phase leads that of the nonsaturated signal shown in chart A of FIG. 3, i.e., it leads the phase of the source voltage $V_L$. This phase shift to a condition of a leading phase angle in the output voltage is due partially to the saturating limiting action of transformer T1 and also to the tuning of the input filter network at a frequency slightly higher than the frequency of source $V_L$, which will be discussed shortly.

Figure 2A:
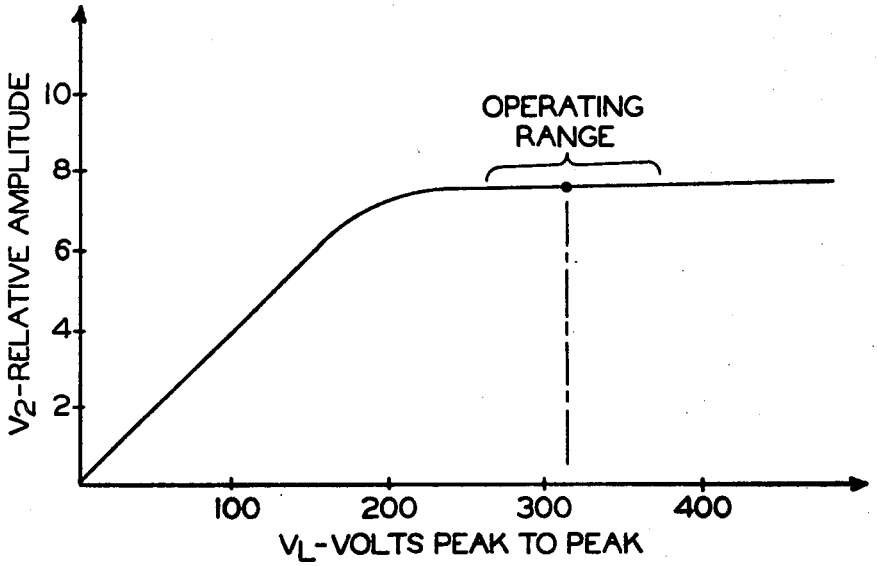
FIG. 2A is a graphic chart illustrating the general voltage regulating characteristics of the circuit of FIG. 1A over a selected range of specific values for the input source.

Voltage regulating characteristics of the circuit arrangement are illustrated by the curve shown in FIG. 2A which plots the relative level of the circuit output signal $V_2$ against the input voltage $V_L$ measured peak-to-peak. It is to be noted that the regulation of output voltage $V_2$ is very good, being within acceptable limits over the operating range of plus or minus 20% of the normal level of the input voltage obtained from the central source. Therefore, within the limits of this operating range of signal $V_L$, variations due to the length of the supply circuit from the central source, irregularities in generating the central voltage, external influences, and other causes are substantially eliminated from output signal $V_2$ supplied to the load.

Figure 2B:
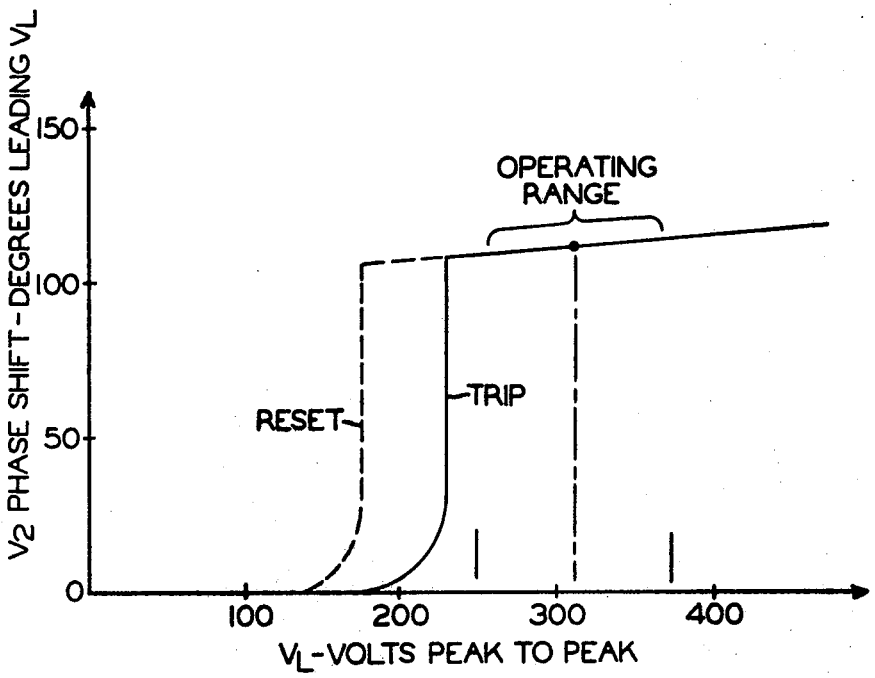
FIG. 2B is another graphic chart illustrating the phase shift characteristics of the circuit of FIG. 1A throughout the same specific voltage range of the input source.

The phase shift characteristic of the circuit arrangement is illustrated by the curve of FIG. 2B which plots the phase shift of output signal $V_2$ against input voltage $V_L$ received from the source. To be noted is the abrupt phase shift at both the trip level (solid line) as signal $V_L$ increases and the separate reset (dash line) curve as input $V_L$ decreases from the normal operating level. However, the phase shift is relatively constant through a normal operating range of the system which is illustrated as being $\pm 20\%$ of the normal supply voltage $V_L$.

Figure 1B:
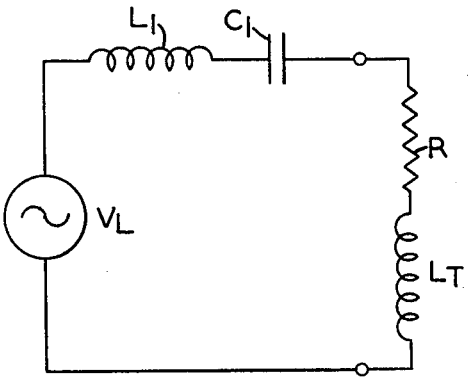
FIG. 1B is a diagrammatic illustration of an equivalent circuit for the arrangement illustrated in FIG. 1A.
Figure 1C:
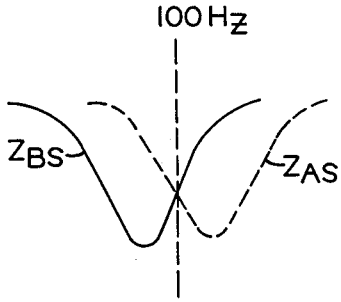
FIG. 1C is a chart illustrating the impedance relationship of the FIG. 1A, 1B circuits to a selected source frequency.

The abrupt phase shift is due to the magnetic saturation of transformer T1, with its square loop hysteresis, in combination with the action of the tuned input filter. The circuit behavior can best be explained by using the equivalent circuit shown in FIG. 1B. Inductor L1 and capacitor C1 of FIG. 1B are the same elements shown in FIG. 1A while inductor $L_T$ represents the total transformer equivalent input inductance and resistor R represents the total transformer and load equivalent resistance. Using a resistive load, values of inductor L1 and capacitor C1 are chosen to resonate the filter path at a frequency somewhat above the frequency of the source which is, for example, 100 Hz. When source voltage $V_L$ is at a low level, input inductance $L_T$ of the unsaturated transformer adds a significant amount of inductance to the overall tuned circuit causing its tuning to shift to a lower frequency, as shown by the solid line impedance relationship curve $Z_{BS}$ in FIG. 1C which represents the impedance of the circuit before saturation. When an increase in input voltage $V_L$ causes transformer saturation, inductance $L_T$ decreases to a very low level causing the circuit tuning to shift to a higher frequency, as shown by the dashed line impedance relationship $Z_{AS}$. It is to be noted that, at the same time, inductor L1 also approaches a saturation level so that its effective inductance decreases, aiding the tuning shift of the input filter.

The tuned circuit shift, which occurs when the transformer goes into full saturation, produces a lead angle phase shift in the output signal in addition to the lead angle phase shift caused by transformer magnetic saturation. This combined phase shift, in the example of FIG. 2B, varies between approximately 112° and 120° throughout the normal operating range of source voltage $V_L$ and leads the input. The difference between the upper trip level and the lower reset level in the phase shift curves of FIG. 2B is determined by the resonant frequency separation of the impedance relations $Z_{BS}$ and $Z_{AS}$ of FIG. 1C. By transposing the transformer secondary leads, this leading phase angle may essentially be subtracted from 180°, resulting in a 68° to 60° phase angle lag in the output. As previously discussed, this is compatible with the phase angle required for operation by the centrifugal relay presently used in AC track circuits. In other words, the lagging phase shift normally appearing in the track voltage at the relay end of an AC track circuit, due to track circuit impedance, is balanced by the phase lag in signal $V_2$ and the local input signal is placed substantially in phase with the other input signal from the rail circuit, as required by the previously mentioned solid-state track relays.

The disclosed circuit arrangement is, by itself, considered to be vital in that its output voltage decreases and/or the desired phase shift is not produced if an element fails in the input network. Obviously, an open circuit in inductor L1, capacitor C1, or the primary winding of transformer T1 removes all output so that the load network is deenergized, a safe condition. If a short circuit occurs in either inductor L1 or capacitor C1, the input impedance is greatly increased, and the selected tuning destroyed, so that the output voltage decreases below the operating range of the load and the phase shift is not obtained. If the primary winding of transformer T1 short circuits, even one turn, the input network is heavily loaded with similar results in the output signal. If the arrangement is used in AC track circuits, in conjunction with the solid-state track relays, the safety features of the relay circuitry are added to this vitality of the primary network.

If the circuit arrangement herein disclosed is used specifically in the vital power varistor circuit arrangement disclosed in my cited U.S. Pat. No. 4,188,002, the saturable transformer T1 herein is substituted in place of the ordinary transformer T1 in FIG. 1 of the patent. The source or input voltage $V_L$ used in the present case becomes the local source $V_{L1}$ of the patent arrangement with the filter network including inductor L1 and capacitor C1 interposed in the primary connections of the transformer. The secondary filtering network including inductor L2 and capacitor C2 as disclosed in this application becomes the filter network of inductor L1 and capacitor C1 in the secondary winding network of the patent. The load resistor $R_L$ herein represents the varistor RV, rectifier Q, and relay TR load of the patented track relay. In addition, the secondary winding of transformer T2 of the relay is also connected in series with the secondary winding of transformer T1 of this case. Connections to the secondary of transformer T1 are selected to reverse the described phase shift so that it lags the input voltage approximately 60° to 70°. This balances the corresponding lagging phase shift occurring in the rail circuit included in the track input and thus substantially places the two input signals to the varistor relay arrangement in phase which is required for proper circuit operation. Although this is a principal use of the disclosed voltage regulator and phase shift circuit disclosed herein, other uses to meet similar requirements are possible and are contemplated by this invention.

The voltage regulator and phase shift circuit arrangement of this invention includes a minimum number of components, none of which are active. It provides a rugged and reliable apparatus which works well over a wide frequency range. Further, electrical noise induced into the local source input voltage is suppressed by both filter networks. With the input and output networks separated by the transformer, high level voltage isolation is also provided. The circuit arrangement can handle approximately ±20% variation in the normal input voltage supplied by the central source. The circuit is applicable at nearly any voltage level and, with an added rectifier and low pass filter network, may also be used as a vital, regulated DC supply arrangement. In other words, the technique herein disclosed is applicable to general vital voltage regulation requirements. The result is an efficient and economic voltage regulation and phase shift arrangement for use in a variety of applications.

Although I have herein shown and described but one vital voltage regulator and phase shift circuit arrangement embodying my invention, it is to be understood that various changes and modifications therein within the scope of the appended claims may be made without departing from the spirit and scope of my invention.

Having now described the invention, what I claim as new and desire to secure by Letters Patent, is:

1. Vital voltage regulator and phase shift apparatus, for supplying, to a load network, a controlled voltage output signal from an energy source having a selected frequency, comprising, (a) a saturable transformer with a primary and a secondary winding and having a saturation limit below the normal voltage level of said source for regulating the voltage of said output signal within predetermined limits over the operating range of said source, (b) an output filter network coupling said transformer secondary winding to said load network and tuned to said selected frequency for blocking harmonic frequency signals produced by the saturation limiting action of said transformer, and (c) an input filter network coupling said transformer primary winding to said source and tuned to cooperate with the equivalent input inductance of the unsaturated transformer for resonating below said selected frequency for holding the output signal in phase with the input signal, (d) said input filter network further responsive to the change in equivalent input inductance of the saturated transformer for shifting the phase of the output signal with respect to the input signal from said source by a predetermined angle.

2. Voltage regulator and phase shift apparatus, as defined in claim 1, in which, (a) said output filter network comprises an inductor and a capacitor connected into a series path and having impedance values selected for series resonance at said selected frequency, (b) said input filter network comprises another inductor and another capacitor connected into a series path and having impedance values selected for series resonance a selected level above said selected frequency, (c) said output filter path is connected in series with said secondary winding to said load network for blocking harmonic frequencies produced by the transformer limiting action upon saturation, (d) said input filter path is connected in series with said primary winding across said source so that the equivalent input inductance of the transformer windings and load network becomes part of the series tuned input circuit, (e) said input circuit is responsive to the equivalent inductance when said transformer is unsaturated for reducing the effective tuning frequency to hold the output signal in phase with the input signal, and (f) said input circuit is further responsive to the reduced equivalent inductance when said transformer is saturated for increasing the effective tuning frequency to shift the phase relationship of the output signal relative to said input signal.

3. Voltage regulator and phase shift apparatus, as defined in claim 2, in which, the secondary winding connections through said output filter to said load network are so poled that the output signal phase leads that of the input signal.

4. Voltage regulator and phase shift apparatus, as defined in claim 2, in which, the secondary winding connections through said output filter path to said load network are so poled that the output signal phase lags that of said input signal.

* * * * *